US006006482A

United States Patent [19]

Kelly

[11] Patent Number: 6,006,482

[45] **Date of Patent: *Dec. 28, 1999**

[54] AIR SEALED ROOF ASSEMBLY HAVING SECONDARY AIR SEALS ISOLATED FROM UNSTABLE PERIMETER PENETRATION AND PROTRUSION AREAS

[76] Inventor: Thomas L. Kelly, 31 Sands St., Waterbury, Conn. 06710

[ * ] Notice: This patent issued on a continued prosecution application filed under 37 CFR 1.53(d), and is subject to the twenty year patent term provisions of 35 U.S.C. 154(a)(2).

[21] Appl. No.: 08/457,324

[22] Filed: Jun. 1, 1995

[51] Int. Cl.[6] ..... E04B 7/00

[52] U.S. Cl. ..... 52/409; 52/58; 52/410

[58] Field of Search ..... 52/746.11, 408, 52/409, 410, 394, 395, 58, 60, 62

[56] References Cited

U.S. PATENT DOCUMENTS

| | | | |
|---|---|---|---|
| 2,373,317 | 4/1945 | Lawson | 52/58 X |
| 2,405,325 | 8/1946 | Parsons et al. | 52/58 |
| 3,365,847 | 1/1968 | Josek | 52/58 X |
| 3,468,086 | 9/1969 | Warner | 52/746.11 X |
| 4,162,597 | 7/1979 | Kelly . | |
| 4,223,486 | 9/1980 | Kelly . | |
| 4,424,650 | 1/1984 | Van Note | 52/746.11 X |
| 4,464,215 | 8/1984 | Cogliano | 52/746.11 X |
| 4,557,081 | 12/1985 | Kelly . | |
| 4,885,887 | 12/1989 | Simmons et al. | 52/746.11 X |
| 4,888,930 | 12/1989 | Kelly . | |
| 4,932,171 | 6/1990 | Beattie | 52/746.11 X |
| 4,996,801 | 3/1991 | Ristow et al. | 52/58 |
| 5,311,716 | 5/1994 | Houssin | 52/410 |
| 5,317,852 | 6/1994 | Howland | 52/408 |
| 5,540,022 | 7/1996 | Morris | 52/746.11 X |
| 5,590,498 | 1/1997 | Mokres | 52/58 X |

*Primary Examiner*—Carl D. Friedman
*Assistant Examiner*—Kevin D. Wilkens
*Attorney, Agent, or Firm*—Cantor Colburn LLP

[57] ABSTRACT

A laterally air permeable roof assembly having seals at perimetrical edges of the roof and at all penetrations of the roof assembly includes secondary air seals spaced from the perimetrical air seals and the protrusion air seals such that the secondary air seals are isolated from unstable areas of the roof. The unstable areas of the roof are areas which experience a high degree of expansion and contraction in different planes.

13 Claims, 13 Drawing Sheets

AIR SEALED ROOF ASSEMBLY HAVING SECONDARY AIR SEALS ISOLATED FROM UNSTABLE PERIMETER PENETRATION AND PROTRUSION AREAS

BACKGROUND OF THE INVENTION

1. Field of the Invention

The present invention related to an improved roof assembly, particularly of the type utilizing flexible membrane material, preferably single-ply material, as the uppermost waterproofing layer of the roof assembly. More particularly, the present invention is directed to an improved roofing assembly of the type utilizing air sealed decking comprising corrugated (preferably metal) sheets, wood decking, concrete planking composite panels, poured concrete and the like placed on a structural framework with the emphasis that this invention is particularly useful in combination with existing roofing assemblies such as built up roofing assemblies.

2. Prior Art

Supportive decking sheets, having corrugations for reinforcement, have been previously used in roofing systems of the type using built-up roof waterproofing and flexible single-ply membranes. These decking sheets are attached to an underlying roof support structure, such as metal I-beams, purlins, joints, a wood frame, or the like. These decking sheets are air permeable at their joints and serve to support insulation boards on the top thereof, which insulation boards are then covered by a roofing waterproofing membrane preferably by a single-ply membrane. Such roof decking sheets are commercially available. Air permeable wood decking composite decking and concrete plank decking are also readily commercially available through construction material supply outlets.

In order to accommodate the wind uplift forces that occur in use of such roofing assemblies on a building, especially the very high forces on tall buildings and structures adjacent perimeter edges of buildings, it has been known to provide venting valves through roof membrane. See U.S. Pat. Nos. 4,223,486 and 4,557,081; which are assigned to Thomas L. Kelly, all of the contents of which are incorporated herein by reference, for examples of venting valve systems that have been used. It has also been known to provide some type of sealing envelope (e.g., membrane or film) that extends over the top of sheet metal or other air permeable decking which effectively seals the insulation boards in an air-tight envelope when topped by the membrane. Certain areas of the perimeter and protrusions through the roof which is being covered are particularly important to seal.

In prior systems, were the deck joints are caulked and sealed or in monolithic decks like a poured-in-place concrete deck, the deck serves as an air-tight seal. In these systems flashing is provided between the deck seal or monolithic concrete deck and the membrane overlying the insulation to form a sealed air-tight envelope at protrusions penetrations and perimeters.

In all of the prior systems which employ an air barrier or seal placed upon the top of an air permeable decking, the wind uplift forces are transferred to the bottom of the air barrier layer pushing upward from inside the building, through the air permeable deck. The integrity of the roof systems vis-a-vis the wind uplift forces depends upon the integrity of the insulation, the insulation skin, and the fastener or adhesive holding capability to the deck to keep the roof assembly in place.

Typically, a roof assembly would incorporate mechanical fasteners that would penetrate the insulation boards and include an overlying washer-type hold-down on top of the insulation. These fasteners would then be screwed or bolted through the insulation and air barrier sheet and roof assembly into the permeable decking underneath. Under certain wind uplift conditions, the connection between the insulation board fasteners and the decking can fail resulting in the insulation board being pushed against the overlying roof waterproofing membrane to cause a roof failure.

Prior roofing systems did not employ air seal barriers from the interior of the building, for example, at penetrations, and wind forces would then focus the stress of uplift pressures through the roof assembly directly into the waterproofing membrane. These prior systems also required a barrier sheet to be interposed between the top of the decking and the bottom of the insulation board or board layers. This air barrier sheet would also then be penetrated by the fasteners for the hold-down of insulation boards. Under certain circumstances during assembly of such roofs, the air barrier could tear at the location of the hold-down fasteners, thereby diluting the air barrier effect The sealed roof deck wind vacuum transfers disclosed in Thomas L. Kelly's U.S. Pat. No. 4,888,930, all of the contents of which are incorporated herein by reference, was a great improvement over the prior art previously discussed. However, the system as disclosed in the '930 patent requires careful placing of the roof deck panels for the application of the caulking between and into the roof decking joints. While well suited for its intended purpose, this system can be burdensome, cumbersome and time consuming since each roof deck panel must be laid in place individually and caulked on the interior of the joint prior to laying down of the overlapping panel.

Further improvements were disclosed in Thomas Kelly's disclosure Ser. No. 08/362,226 filed Dec. 23, 1994 which is incorporated herein by reference. Although all of the aforementioned disclosures have led to improvement of sealed roof deck wind vacuum transfer systems, there remains a need for further improvement.

Notwithstanding, the exceptional improvements in wind uplift protection, which improvements have significantly reduced the incidents of roof failure associated with this effect, storm grade winds, particularly those over 100 mph, are quite capable of tearing an entire roof off the building to which it is affixed. The two reasons for this are understandable upon a brief review of the dynamics of wind uplift and thermal expansion and contraction of roof deck and perimeter structures.

The dynamics involved in wind uplifts are created by two fluid streams and a principle of physics known as the Bernoulli principle. The fluid streams at issue are: first, the flow of air across the top of the building and second the upward flow of air caused by a horizontal air flow colliding with the side of the building and being redirected upwards. The two air streams create a horizontal vortex at the windward edge of the building which urges the roofing membrane upward. This, in combination with the Bernoulli principle, which states that as the velocity of a fluid increases, pressure (as well as temperature) decreases, thus providing lift, is a formidable opponent in the struggle to maintain the roof membrane in its desired position. Add to this the instability caused by thermal expansion and contraction of the roof deck and surrounding structures, (as well as structures extending through the roof deck) and it is easy to comprehend first why roofs blow off.

Thermal expansion and contraction of the various structures is concentrated mainly in the longest direction of the structure. For example, a roof deck will expand and contract mostly in the horizontal direction while a building wall and parapet will expand and contract mostly vertically. This discordant movement creates substantial stress on the air sealing compositions and structures (such as nailers) in the precise locations most critical to securing the entire roof structure. Alternately stated, the described movement loosens nailers and fasteners in the perimeter or penetration areas most susceptible to wind uplift forces. Moreover, once these fastening structures have been defeated there is little to prevent the entirety of the roof from blowing off. As stated above, it is not difficult to comprehend why roofs blow off.

Heretofore, no reasonable or effective method or apparatus has been suggested to alleviate this obviously vexatious situation.

SUMMARY OF THE INVENTION

The above-discussed and other drawbacks and deficiencies of the prior art are overcome or alleviated by the roofing assembly of the invention and the method of construction thereof.

Due to the above discussed contributing factors to roof blow off, it is advantageous to attach the membrane in an alternate location which is not subject to incongruous thermal cycling. It is further important to recognize that the under-membrane area must still be air sealed, and clearly the perimeter and penetration areas must be membrane covered for weather proofness.

In order to provide advantages such as decreased incidence of roof failure due to blow-off, reduction in time and cost of roof installation, reduction in extent of the roof removed during a blow-off, etc., attachment of the roof membrane is effected at a predetermined distance from the zone of instability.

The zone of instability is that area surrounding a penetration, protrusion or perimeter which is indirectly affected by thermal cycling in the joint. Fastening of the membrane is generally accomplished via fasteners and termination bars urging the membrane toward the deck sandwiching an adhesive sealant substance between the roof deck and the membrane. Fastening the membrane in this manner to an air sealed roof deck prevents air from infiltrating the area between the roof deck and the membrane. A secure roof is thus provided which is not rendered unstable due to instability of the joints. Various assemblies are contemplated for completing the roof assembly to weatherproof that part of the structure excluded by attachment of the main roof membrane interiorly of any joint.

The separate attachment of an area of membrane not included in the main roof covering is that which provides the benefit of a reduction in the extent of roof blow off. More specifically, the extreme uplift created by the various above discussed forces at the upwind side of the roof will blow off (if strong enough) only the perimetrical edge of the roof and will leave the main roof membrane attached thus protecting the building contents.

BRIEF DESCRIPTION OF THE DRAWINGS

Referring now to the drawings wherein like elements are numbered alike in the several FIGURES.

DETAILED DESCRIPTION OF THE PREFERRED EMBODIMENTS

Figure 1:
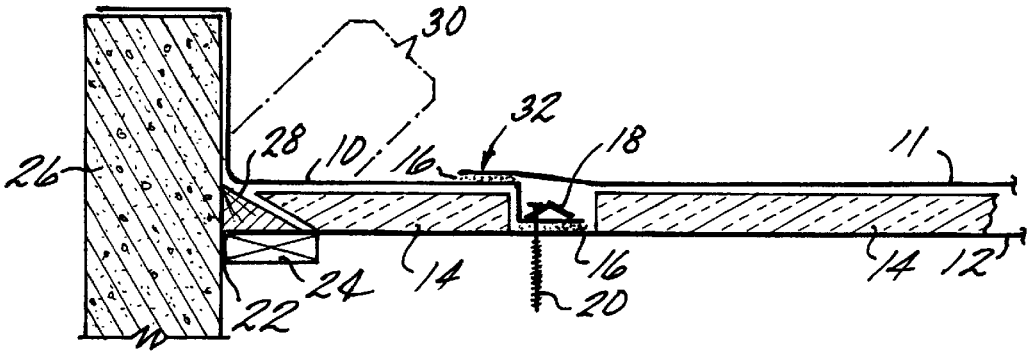
FIG. 1 is a schematic cross section of a roof of the invention with an exterior membrane anchored to the roof substrate.

Each of the drawing figures in this disclosure illustrates a distinct embodiment of the invention which will be described individually and seriatim hereunder. It should be appreciated, however, that all of the embodiments include the same overriding emphasis; that is that fastening of the membrane to any substrate is not accomplished closer than a predetermined distance from any joints between a roof deck and a wall of the building, whether or not said wall includes a parapet, or between the roof deck and any protrusion, penetration, etc. This, as stated above, is because such joints and the zone of instability immediately therearound, tend to destabilize the fasteners securing the membrane which ultimately leads to roof failure.

In order to alleviate the problem the fastening devices have been repositioned to be a minimum of 10 inches from any joint or interruption in the roof substrate. The most preferred predetermined distance inward from the interruption is 12 inches with a preferred range of about 12 to about 18 inches from such interruptions. The maximum practical distance from interruptions is approximately 48 inches.

This assembly type provides all of the benefits above discussed by allowing the unstable joint area to move without any significant impact on the roof membrane because the membrane is simply loose laid over that area. Moreover, the assembly reduces catastrophic blow-off by providing a tear away section of the roof membrane in the most susceptible region of the roof while maintaining the remainder (main section) of the roof membrane securely attached. It is to be assumed that there is in place an existing roof or other preferably sealed substrate.

Figure 2:
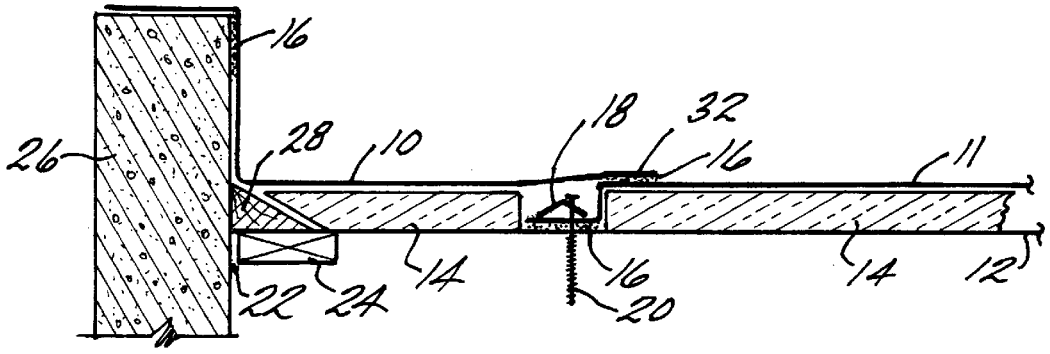
FIG. 2 is a schematic cross section of a roof of the invention with a main membrane anchored to the roof substrate.

In FIG. 1, an embodiment directed to a roof perimeter interruption is illustrated. In this embodiment, upon substrate 12 is laid any one of a number of roofing materials 14 such as insulation, gypsum, OSB, fiber board, or wood. These materials are utilized for their generally intended purposes. In FIG. 1, materials 14 are added which require that the membranes 10 and 11 be spaced from the substrate. Therefore, a break in material 14 is made where the membrane is to be mechanically fastened to the substrate 12. Outer membrane 10 is mechanically fixed to substrate 12 with mastic or adhesive 16 (caulk, butyl rubber, silicon, urethane and spray foam seal material), a termination bar 18 and screw 20. The fixation point is at least 10 inches and preferably 12–18 inches from joint 22. For purposes of clarity a nailer 24, parapet 26 and cant strip 28 are also illustrated. Outer membrane 10 is then laid over the parapet 26 and sealed in an appropriate manner (not shown). The result as one of skill in the art will readily appreciate is that the zone of instability 30 is free to move about under membrane 10 without disturbing the integrity of membrane 10. In order to complete the roof assembly the main roof membrane 11 is laid out and secured via adhesive or welding to the attachment area 32 as illustrated. It will be appreciated that even if the fastening of outer membrane 10 fails as the exposed parapet 26, the main roof will still be intact In a second embodiment of the invention, illustrated in FIG. 2 a very similar roof assembly is provided, however, reversing the attachments. Main roof membrane 11 is secured via mastic or adhesive 16, termination bar 18 and screw 20 and in this case the outer membrane 10 is overlaid on the main membrane 11 and secured by adhesive or welding in the attachment area 32 as illustrated. This embodiment provides the benefit of enabling a roof team to seal the great majority of the roof with membrane 11 and leave the highly work intensive perimeter area for a better day without significantly endangering or damaging the building or its contents from the onset of inclement weather. This embodiment, therefore, provides the advantages detailed above and in addition, a practical advantage.

It will be appreciated that attachment area 32 is located such that the termination bar and fastener are covered thus providing a sealed roof assembly.

Figure 3:
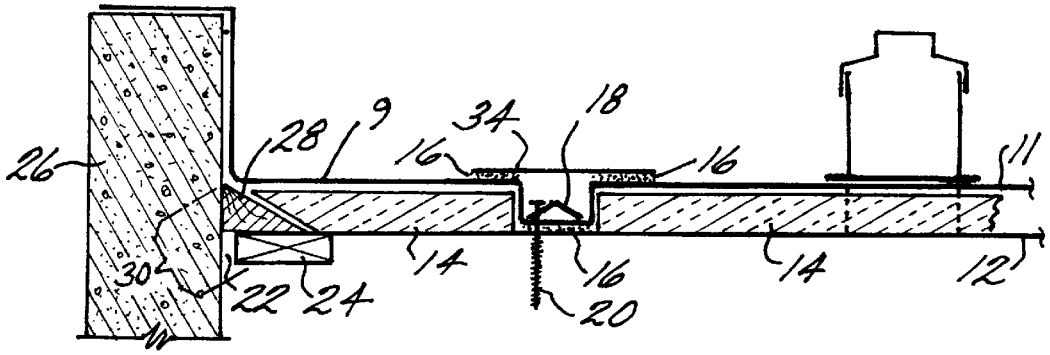
FIG. 3 is a schematic cross section of another embodiment of the invention illustrating a mechanical fastener through a monolithic membrane.

In a third embodiment of the invention, illustrated in FIG. 3, a single monolithic membrane 9 is employed instead of the outer and main membrane 10 and 11. As is easily appreciated by a brief perusal of drawing FIG. 3, mechanical fixing of the membrane 9 to the substrate 12 is accomplished similarly to FIGS. 1 and 2. The mechanical fixating apparatii, e.g., screw 20 termination bar 18 and mastic or adhesive 16 is then sealed over, preferably with an adhesive and weatherproof tape 34 or a piece of membrane (not specifically shown) bonded or glued to the membrane 9.

Figure 4:
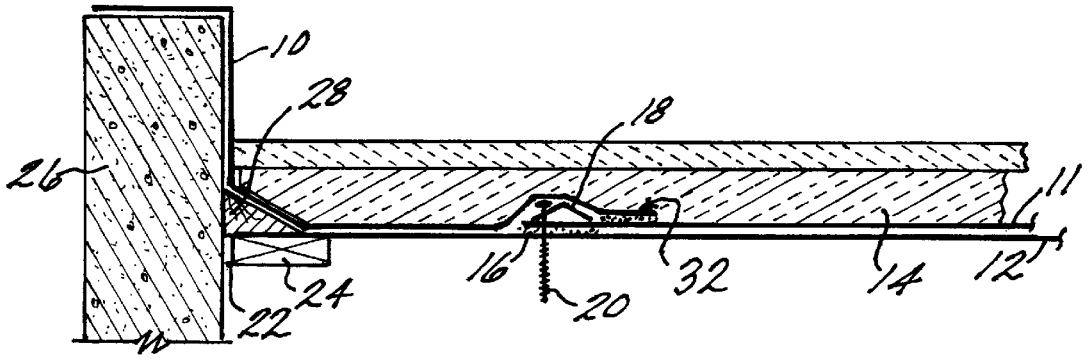
FIG. 4 is another embodiment of the invention wherein an inverted roof membrane assembly is employed and the main section of said membrane being mechanically affixed to roof substrate.

In FIG. 4, a further embodiment of the invention is illustrated in which an inverted roof membrane assembly type of roof structure is employed. This type of roof can benefit from the invention just as the embodiments discussed above do. In this embodiment, a main membrane 11 is laid on the majority of the substrate and is sealed and mechanically fixed at the predetermined distance from the perimeter interruption or joint 22 of preferably from 12–18 inches and possibly from 10 to 48 inches in the same manner as above described. The perimeter membrane 10 is then laid over the mechanical fastener and adhesively bonded or welded to the main membrane at 32. Perimeter membrane 10 is subsequently secured to parapet 26. Once this membrane assembly is complete, insulation and a weighted layer are installed.

Figure 5:
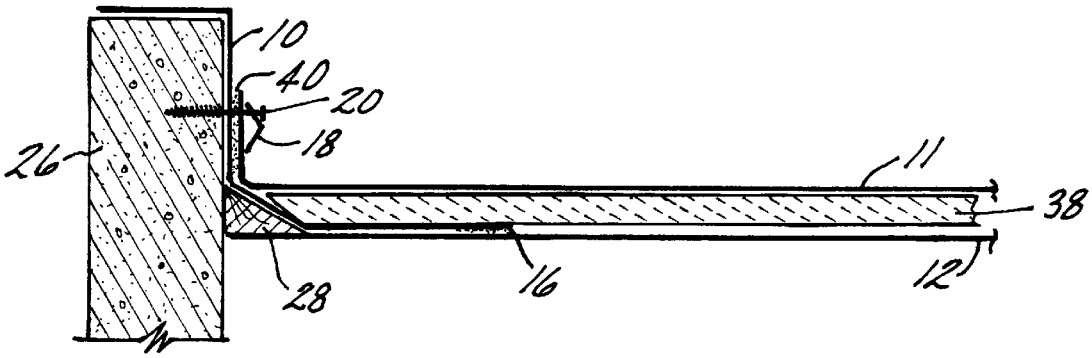
FIG. 5 is another embodiment of the invention wherein an outer membrane extends over a parapet wall and under a weighted board and is adhesively adhered to the roof substrate the main membrane is adhered to the outer membrane.

In FIG. 5, a fifth embodiment of the invention is illustrated wherein the attachment of the various elements of the roof assembly are again maintained in a predetermined spaced relationship to any interruption of the substrate roof deck 12. In this particular embodiment, the substrate 12 is not structurally capable of accepting mechanical fasteners. Therefore, in this embodiment, membrane 10 is affixed to the parapet 26 with adhesive and mechanical fastener assembly 18, 20 and affixed to the substrate with adhesive material only. Weighted board 38 is then placed over the perimeter membrane 10 and the main membrane 11 is laid and secured to the parapet with adhesive 40, screw 20 and termination bar 18.

Figure 6:
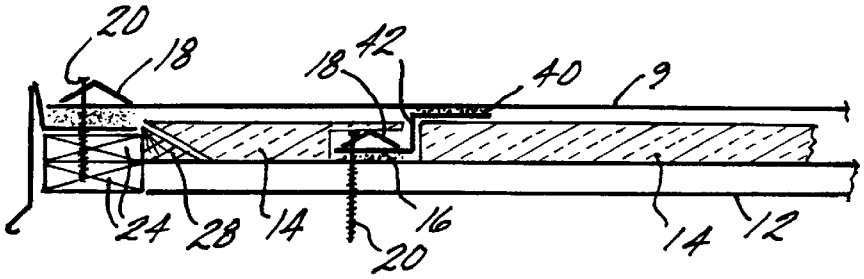
FIG. 6 is another embodiment wherein an auxiliary membrane member is adhered to the main membrane and mechanically attached to a substrate.
Figure 7:
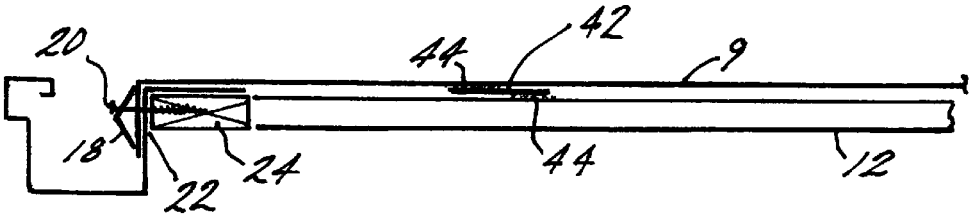
FIG. 7 is an embodiment similar to FIG. 6 without insulation.

In a set of embodiments, referring to FIGS. 6 and 7, roof structures without parapets are contemplated. In FIG. 6 a monolithic membrane 9 is employed and is bonded adhesively with adhesive 40 to an interim membrane 42 which is in turn fastened to substrate 12 with termination bar 18 and screw 20 and mastic or adhesive 16. This provides a sealed structure at about the predetermined distance and allows fastening of the edge of the roof membrane 9 in any desired way while maintaining a sealed main roof section even if the perimeter fasteners fail. Insulation 14 is provided.

FIG. 7 represents another embodiment wherein the monolithic membrane 9 is adhered to an interim membrane 42 which is then adhered to the substrate 12. The membranes are either adhesively adhered or welded at 44. Membrane 9 is secured mechanically to a nailer 24 at the perimeter thereof. In this embodiment insulation 14 is omitted.

Figure 8:
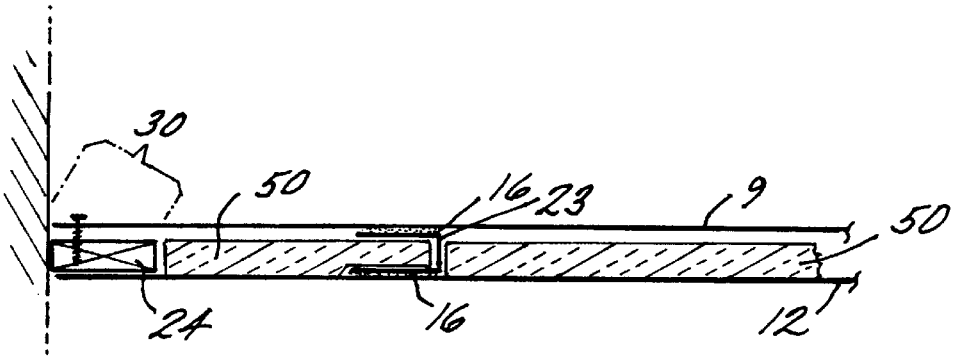
FIG. 8 illustrates a "c" channel secondary seal arrangement.

In FIG. 8 a roof membrane of the monolithic type (9) is secured to nailer 24 in the conventional way thus being subject to the thermal cycling movements of that area and potential air seal and mechanical fastener failure. The assembly is improved over the conventional assembly, however, since it further includes a "C" channel 23 adhered to the roof substrate with mastic or adhesive 16 or similar compound. As illustrated in the drawing the "C" channel extends through insulation 50 and then horizontal along the top thereof. The horizontal section is adhered to membrane 9 with mastic or adhesive 16. This assembly is an advance over prior art structures because if the mechanical fastener in the nailer is defeated the main part of the roof will still be air sealed and secured since the "C" channel is not as susceptible to thermal cycling as is the nailer 24.

Figure 9:
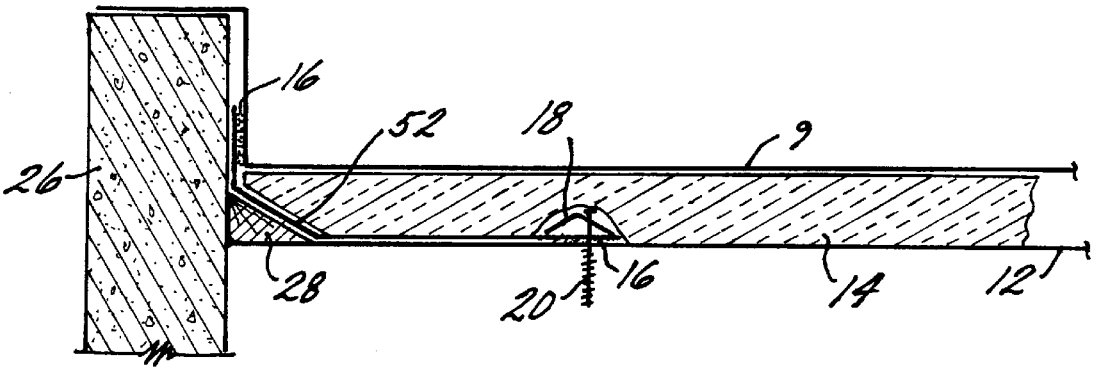
FIG. 9 is another embodiment of the invention.

FIG. 9 illustrates a ninth embodiment of the invention wherein an air seal membrane 52 spans the zone of instability 30 and is secured to the substrate by mechanical fastening means such as screw 20 termination bar 18 and mastic or adhesive 16. The mechanical fastener is positioned in the preferred area as described hereinbefore. The air seal membrane 52 then extends over the area of instability and partially up a parapet where it is adhesively bonded or heat welded to a monolithic membrane 9 extending over the parapet and over the entirety over the roof covering insulation material positioned immediately above the air seal membrane 52.

Figure 10:
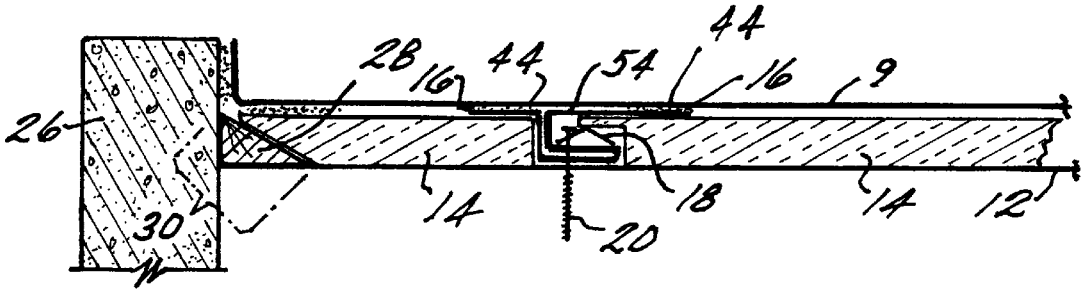
FIG. 10 illustrated another embodiment of the invention wherein an auxiliary membrane is adhered to the main membrane and secured to the substrate.

In FIG. 10 a tenth embodiment of the invention is illustrated where an insulation 14 is placed immediately over substrate 12, said insulation being broken at a predetermined distance from the zone of instability such that an attachment member 54 which can be constructed of metal, wood, membrane material, etc. is extended down below insulation 14 so as to be affixed to substrate 12 of predetermined distance from zone of instability. The attachment member 54 then extends above the insulation 14 and extends in either direction from the break in said insulation and is either adhesively attached or heat welded to the monolithic membrane 9. Membrane 9 is then adhesively attached to parapet 26.

Figure 11:
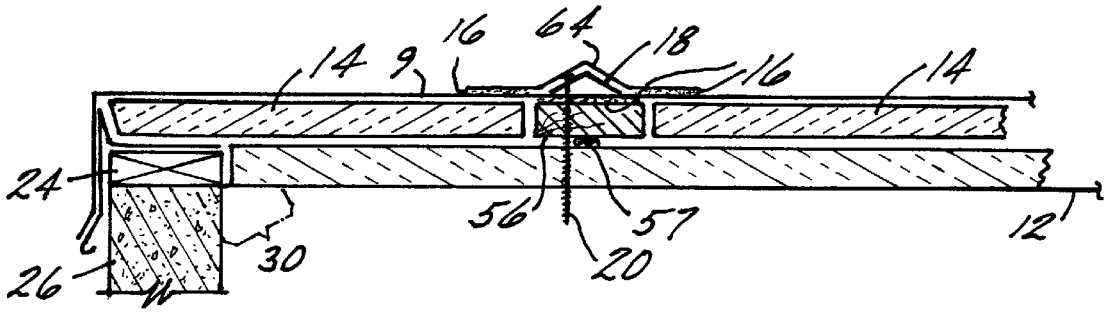
FIG. 11 is another embodiment wherein a board is used as an air seal.

FIG. 11 is another embodiment of the invention wherein a monolithic membrane 9 is stretched over the edge of the building and back across the building roof structure immediately above insulation which is placed upon an old roof structure. Installation is broken at a predetermined distance from the zone of instability 30 and a board 56 preferably wood, but will be appreciated that plastic is a possibility, is inserted within the break as illustrated in FIG. 11 with gum 57 positioned thereunder to air seal the bottom of the membrane structure. Mastic or adhesive 16 is placed atop the board immediately underneath monolithic membrane 9 and the entire stack of members is compressed and mechanically fastened to substrate preferably with a screw 20 through a termination bar 18. Assembly is put together right over the old membrane so that the membrane can act as the air seal.

Figure 12:
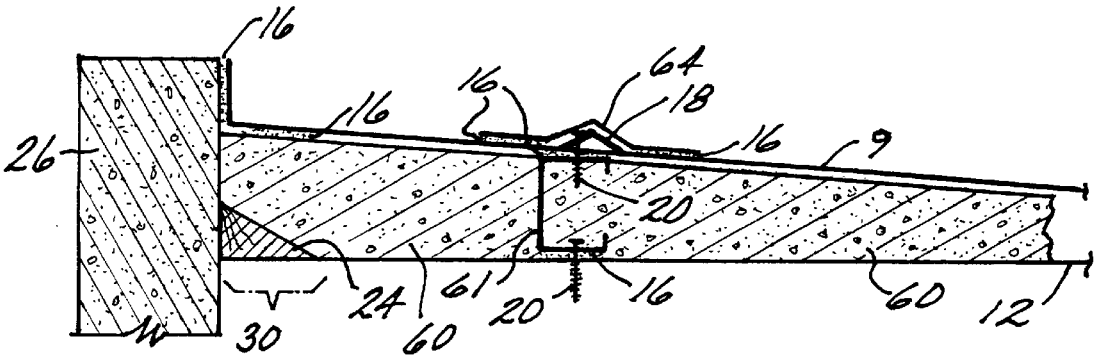
FIG. 12 is a pitched roof embodiment employing foam concrete and a 'C' channel air seal.

FIG. 12 illustrates another type of roof structure wherein it is desired to provide a pitch to the roof so that liquid does not collect thereon. In this type of structure, the old substrate is provided with a pitch using a foam concrete material 60. In order to construct this type of roof, a "C" channel 61 is air sealed to the substrate 12 with mastic or adhesive 16 and then fastened thereto with screw 20. Foaming concrete material 60 is then poured on either side of channel 61, said channel, of course, having been affixed at predetermined distance zone of instability 30. Once foaming concrete material 60 is poured in the desired angle exposed to top section 62 of channel 61, the channel having been sized appropriately to allow the desired pitch with the foaming concrete and still maintain an exposed surface for attachment of the membrane. Immediately above the surface 62, mastic or adhesive 16 is applied thereto and membrane 9 is applied thereover. Membrane 9 is then mechanically fastened to channel 61 which screw 20 and termination bar 18. In order to completely waterproof a perforation of the membrane by screw 20, the secondary membrane 64 is adhesively secured or heat welded to membrane 9 purging termination bar 18 and screw 20.

Figure 13:
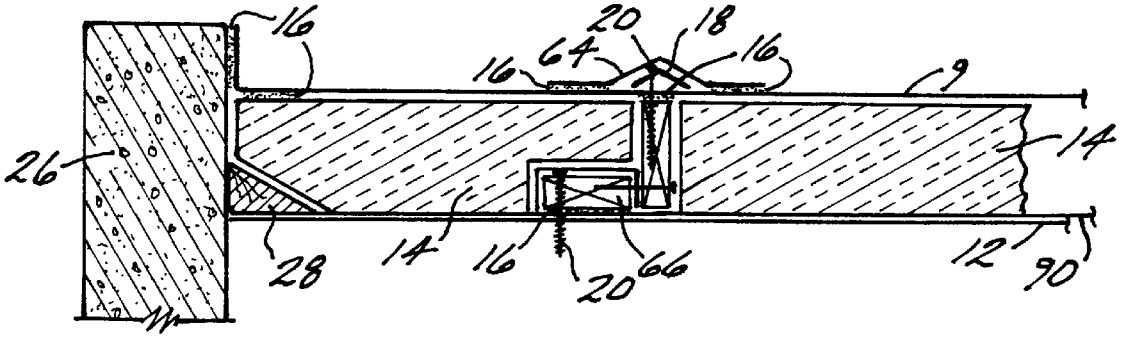
FIG. 13 is a pitched roof using a wood constructed air seal.

In FIG. 13 a thirteenth embodiment of the invention is illustrated wherein a large amount of insulation 14 is necessary for the application. Thus, in order to secure membrane 9 to sealed roof deck 12 preferably two boards are utilized which have been fastened in an L-structure 66 so that one leg of the L can be fastened to the substrate material with a screw 20, and a sealing composition or mastic or adhesive 16 and the membrane may be fastened via mastic or adhesive 16, screw 20 and termination bar 18. The fastener is sealed over by a secondary membrane 64 with a sealant 16 as in FIG. 12.

Figure 14:
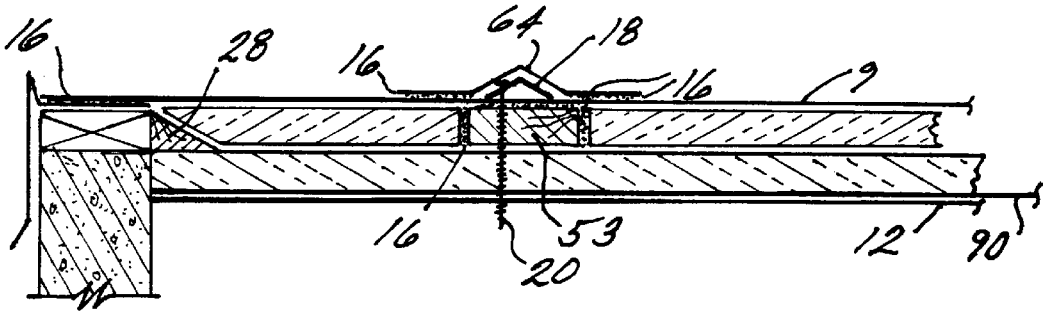
FIG. 14 is an embodiment of the invention wherein an adhesive cover block is used as a rear seal and is secured with a mechanical fastener.

Illustrated in FIG. 14 is a roof structure very similar to FIG. 11 with a difference being that the entire wood block is coated with mastic or adhesive 16 for superior sealing.

Figure 15:
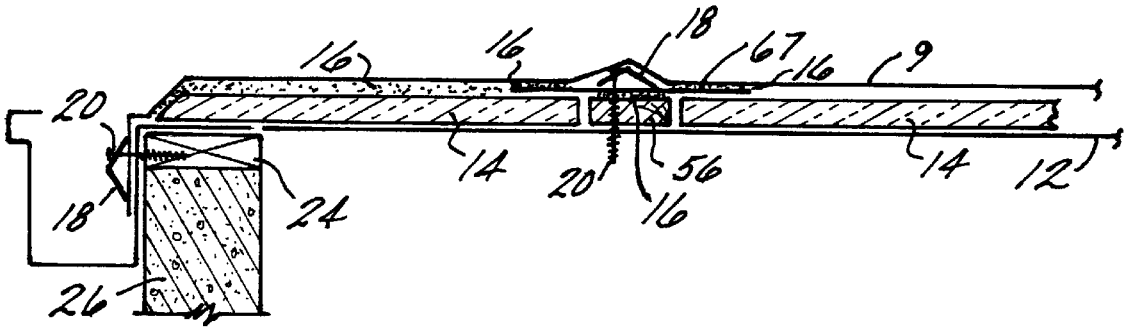
FIG. 15 alternate embodiment similar to FIG. 14.

FIG. 15 illustrates a roof assembly very similar to FIG. 14, however, in this embodiment, the secondary membrane 64 has been avoided by placing a section of membrane 67 underneath monolithic membrane 9 which is secured to board 56 with mastic or adhesive sealant 16 and mechanical means as set forth above and then it is secured to the underside of monolithic membrane 9 with mastic or other adhesive 16 or heat welded.

This roof is secured at the edge of the building with inwardly directed screw 20 maintaining a termination bar 18 against the side of the building into nailer 24.

Figure 16:
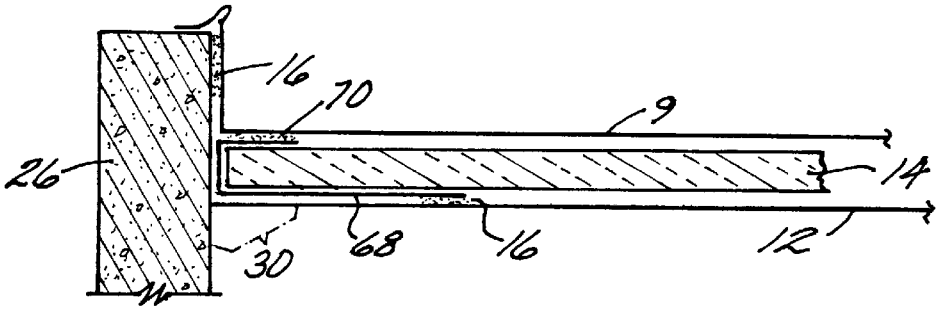
FIG. 16 utilizes an auxiliary air seal membrane wrapped around insulation.

FIG. 16 illustrates another alternate embodiment of the invention wherein the air seal membrane 68 is adhesively attached to the substrate 12 at a predetermined distance from the zone of instability. Insulation is then laid over this air seal membrane 68, the air seal membrane 68 being folded over the insulation 14, a monolithic membrane 9 is then laid over the entire roof structure and bonded to the air seal membrane 68 at the attachment area indicated as numeral 70. A membrane 9 then continues over parapet 26 and is secured as hereinabove described or in a conventional manner.

Figure 17:
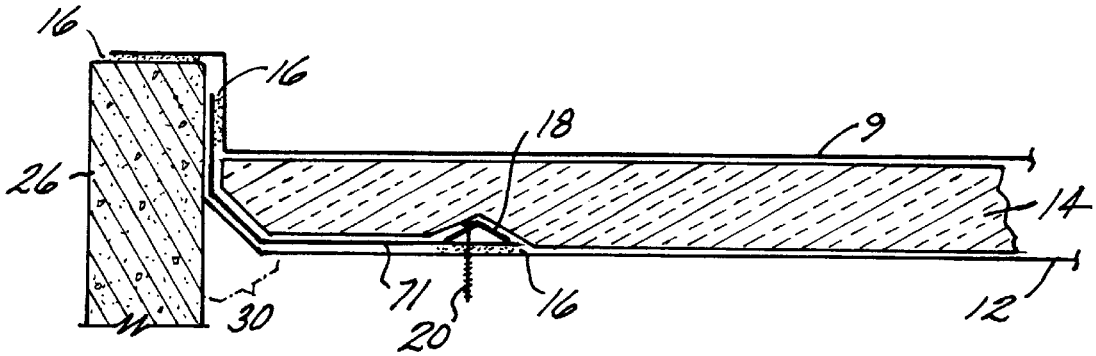
FIG. 17 is another embodiment of the invention mechanically sealed to the substrate or adhesively adhered to a main membrane.
Figure 18:
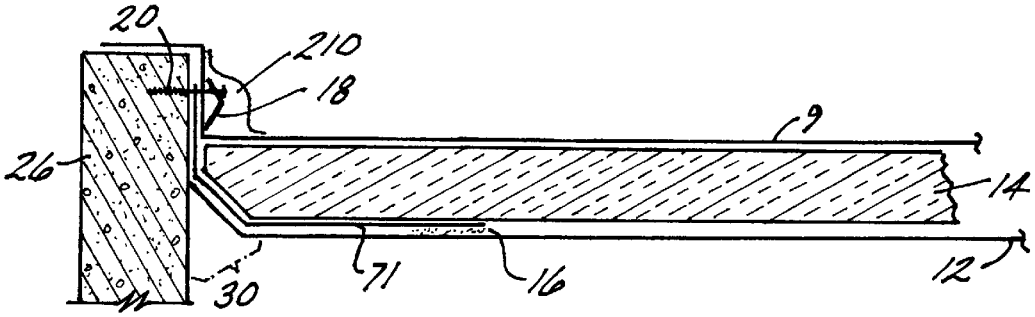
FIG. 18 is an alternate embodiment moving the mechanical fastener from the substrate to the parapet.

FIGS. 17 and 18 represent the same type of roof assembly but require that a mechanical fastener is repositioned due to structural requirements of the building. The air seal membrane 71 in each case is secured so that it bridges the area of instability 30. In FIG. 17 a mechanical fastener of the type described above is utilized to fasten directly into the roof substrate, a sealant 16 is placed under membrane 71 at the attachment site. In FIG. 18, however, the structure of substrate 12 dictates that merely an adhesive material be utilized to seal membrane 71 to the substrate 12, i.e., the substrate lacks the structural stability to hold a screw. Conversely, one of skill in the art will readily understand that parapet 26, which normally possess the structural stability to bear mechanical fasteners, may be used (FIG. 18) as a structure for mechanical fastening of the membrane 71 or the membrane simply may be adhesively fastened to monolithic membrane 9.

Figure 19:
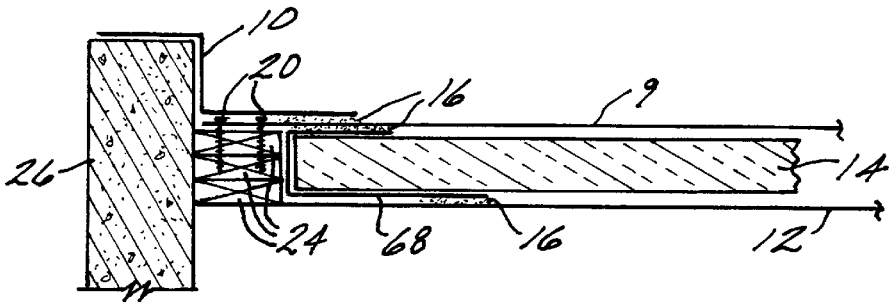
FIG. 19 is similar to FIG. 16, however, further includes nailers for mechanically fastening the main membrane.
Figure 20:
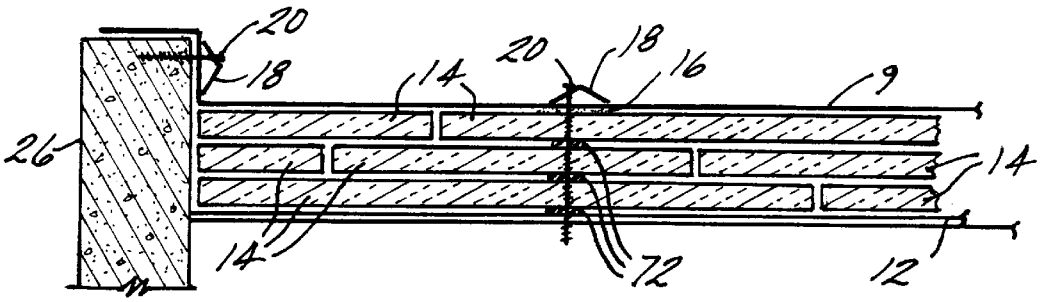
FIG. 20 is a schematic drawing figure illustrating a sealed roof having several layers of roofing materials.

FIG. 19 illustrates in another embodiment of the invention where a short piece of membrane 68 is attached to the substrate 12 by adhesive 16 which short piece of membrane wraps around insulation 14 and adheres to membrane 9 by adhesive 16. Membrane 9 is secured at the perimeter edge of the roof by screws 20 attaching it to nailers 24. To seal the penetration of the screws 20 and outer membrane portion 10 is adhered to the top of membrane 9 and it is extended to cover parapet wall 26. The embodiment of FIG. 20, a buildup of insulation 14 and a mosaic pattern is provided as being appropriate for the application. In order to air seal the area under the monolithic membrane 9, gummy material 72 is placed between each of the sheets of insulation, the gummy material being directly in line with the anticipated screw 20 mounted in termination bar 18 and driven through all of the layers into the existing roof deck to secure the entire assembly.

Figure 21:
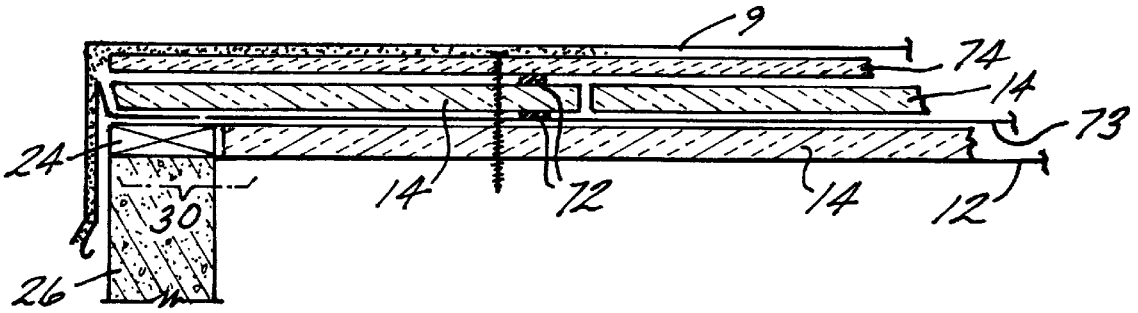
FIG. 21 is an alternate embodiment of FIG. 20.

In the embodiment of FIG. 21, an existing roof deck having a membrane 73 is added to with insulation and wood, fiberboard, or gypboard 74 indispersed with a gummy material 72. The board 74 and insulation 14 are then compressed through a mechanical fastener anchored in the original substrate. A monolithic film 9 is placed over the entirety of the roof and is glued to the wood, fiberboard, or gypsum layer 74 so that no holes are made in the membrane. It will be appreciated that placement of the screw is away from the zone of instability 30.

Figure 22:
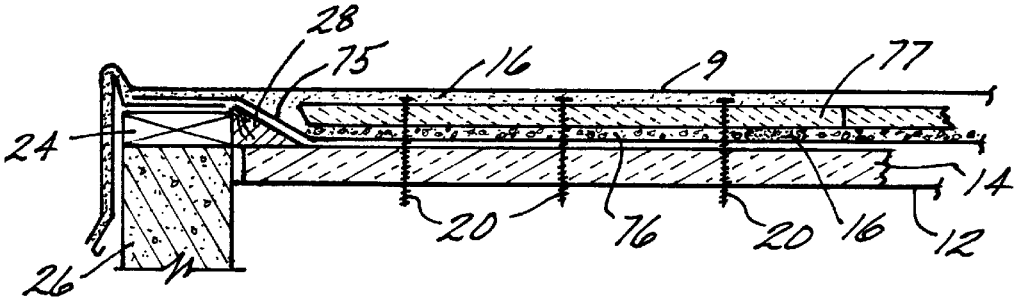
FIG. 22 is a schematic view of a reroofing operation having a secondary isolated air seal.

In FIG. 22, the existing membrane roof 75 having gravel thereon is used as the air seal and is then overlaid with material 77 which is either OSB or gypboard. Material 77 is secured to the existing roof with screws 20, all of which are isolated from any areas susceptible to thermocycling. A new monolithic membrane 9 is then glued over the OSB or gypboard to complete the roof.

Figure 23:
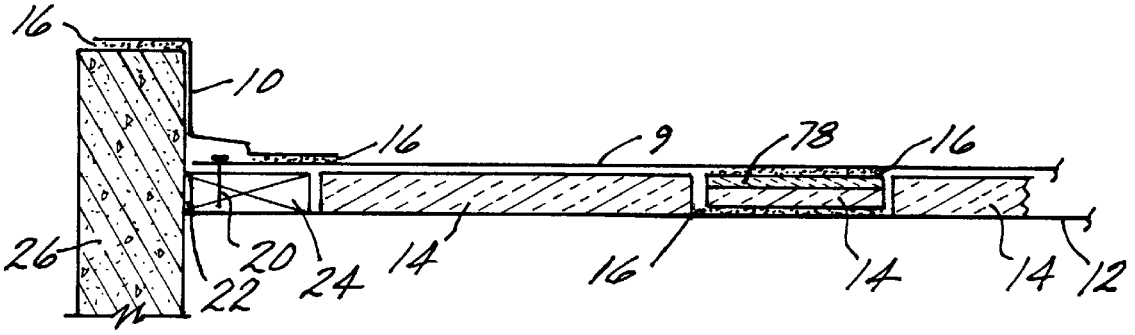
FIG. 23 is an embodiment of the invention wherein the secondary air seal is created by adhesively bonding the insulation and other roofing material to the substrate.

FIG. 23 illustrates a further embodiment of the invention wherein the roof membrane is secured in a conventional manner to a nailer 24 at the perimeter of the roof, however, the insulation immediately under membrane 9 is separated such that a smaller layer of insulation may be bonded by adhesive or mastic, etc. to the substrate 12 and thereabove to a layer of OSB 78 to which the membrane 9 is bonded. It will be appreciated that these bonds are at least the preferred 12–18 inches from the joint 22. Membrane 9 is further secured to the roof deck in a conventional way to nailer 24.

Figure 24:
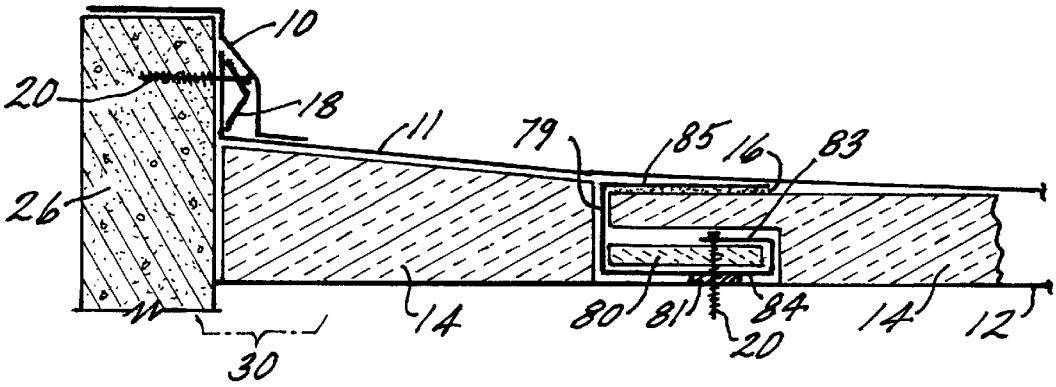
FIG. 24 is an alternate schematic view of a pitched roof assembly using insulation as the pitch creating material and a "G" channel air seal.
Figure 25:
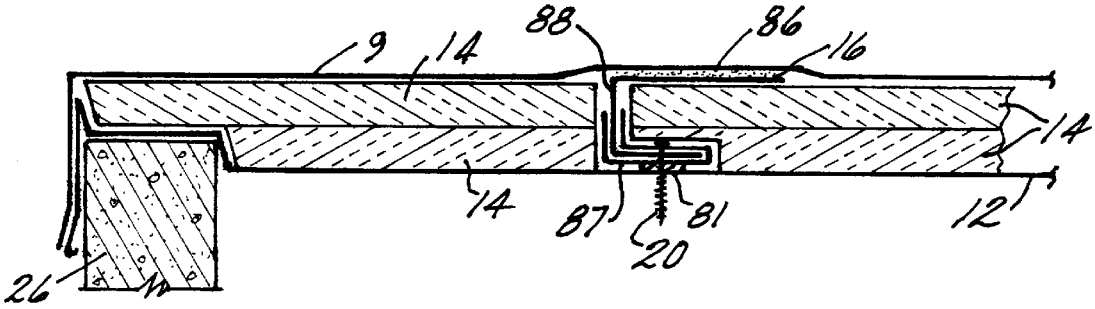
FIG. 25 is an alternate schematic illustration of the invention wherein a metal capsule increases membrane strength at the area for mechanical attachment to the substrate.

FIG. 24 illustrates yet another embodiment of the invention wherein a pitched roof situation is desired, said pitch being provided by a thick, angled layer of insulation. The insulation is broken at a predetermined distance from the zone of instability 30 and g-shaped channel 79 is inserted therein as shown in FIG. 25. The g-shaped channel is preferably constructed of metal. Within the bottom of the g-shaped channel, a board 80 is positioned, preferably consisting of OSB. An air block 81 is positioned underneath g-channel 79 and a screw 20 is then driven through both sections 83 and 84 of g-channel 79, through OSB 80 and through block 81 into existing roof substrate 12. As will be appreciated, adhesive, gummy material or mastic may be desirable to seal the structure. Top 85 of g-channel 79 is positioned above insulation 14 and is adhesively bonded or welded at 86 to membrane 11. Perimeter membrane 9 extends over main membrane 11 to waterproof the mechanical fastener assembly comprising screw 20 and termination bar 18 securing the edge of membrane 11 to the parapet 26.

In FIG. 25 a very similar embodiment of the invention is illustrated wherein the channel 88 is not a g-shape but is merely in a c-shape and a membrane ferrule 87 is crimped around channel 88. The channel 88 is preferably made from membrane material. Channel 88 extends to above insulation 14 and is bonded or welded at 86 as shown. Ferrule 87 is added to prevent membrane 88 from being pulled away from fastener 20, by which membrane 88 is attached to substrate 12. It should be recognized that block 81 (with appropriate sealing composition) is interposed between ferrule 87 and substrate 12.

Figure 26:
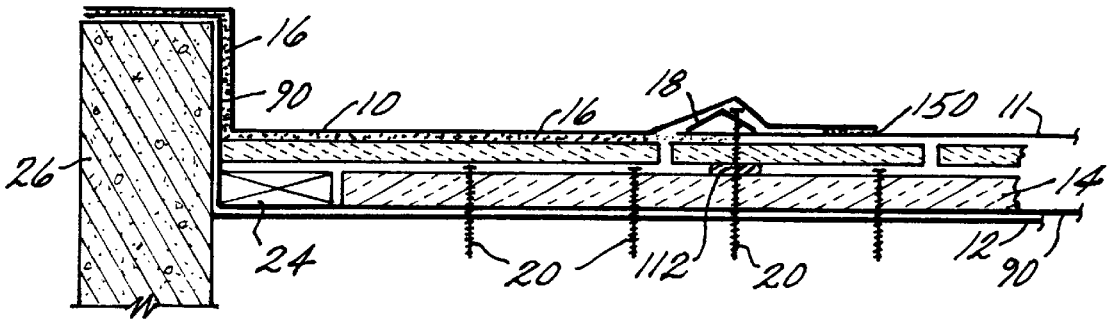
FIG. 26 is another alternate configuration of the invention.

FIG. 26 illustrates a twenty-sixth embodiment of the invention wherein main membrane 11 is mechanically fastened by screw 20 and termination bar 18 which extend seriatim through membrane 11, OSB, air seal rope 112, insulation 14, air seal 90 and substrate 12. Outer membrane 10 is then overlaid on the termination bar 18 and attached by tape 150. Outer membrane 10 is then laid out and over parapet 26 and attached thereto by adhesive 16.

Figure 27:
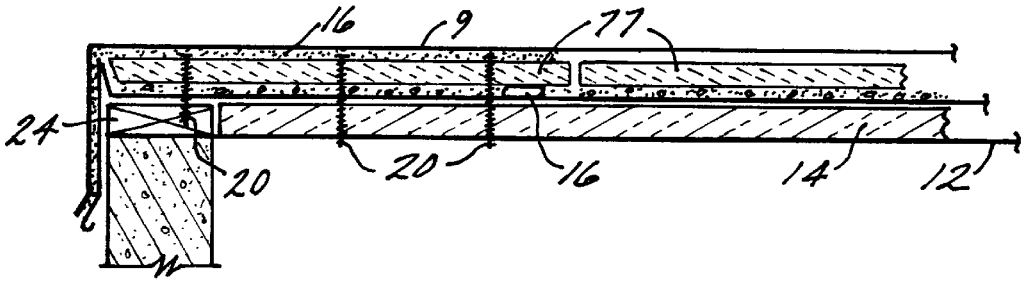
FIG. 27 is an illustration of a reroofing embodiment wherein holes are avoided in the final membrane and the secondary air seal is isolated from the zone of instability.

FIG. 27 illustrated yet another embodiment of the invention which is very similar to drawing FIG. 22, however, in this embodiment, the OSB 77 is secured at the perimeter by screw 20 into nailer 29 as well as screws 20 into the roof substrate 12.

Figure 28:
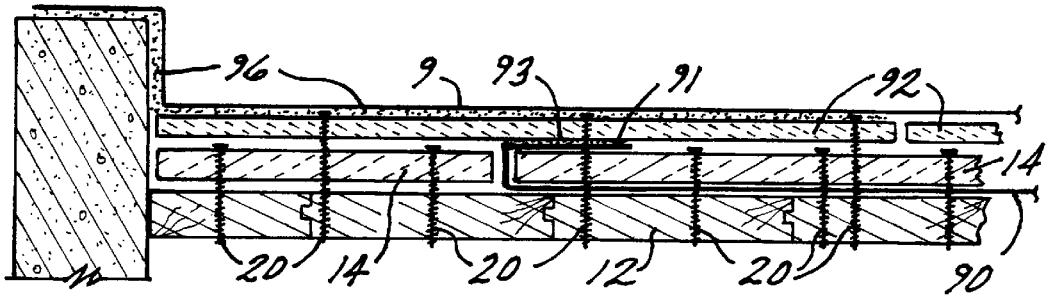
FIG. 28 is another schematic where the main air barrier is folded over insulation and bonded to OSB.

In FIG. 28, a wood deck structure is the substrate 12. Over the substrate 12 is placed an air seal 90. Then a slab of insulation 14 is placed over the membrane 90 in the main area of the roof. The edge of the membrane 90 is then folded over insulation 14, and a second slab of insulation $\mathbf{14}_2$ is placed along the perimeter of $\mathbf{14}_1$. Overlay 91 of membrane 90 is bonded to OSB 92 at area 93. The bonding can be accomplished by gummy material, adhesive, mastic or welding, etc. The bonded area 93 provides the air tight seal under the main roof section. OSB 92 is secured in place by a plurality of screws 20 which extend through insulation 14 and into wood deck substrate 12. Over the second OSB 92 is spread more bonding agent (indicated as 96) and then membrane 9 is adhered thereto over the entirety of the roof.

Figure 29:
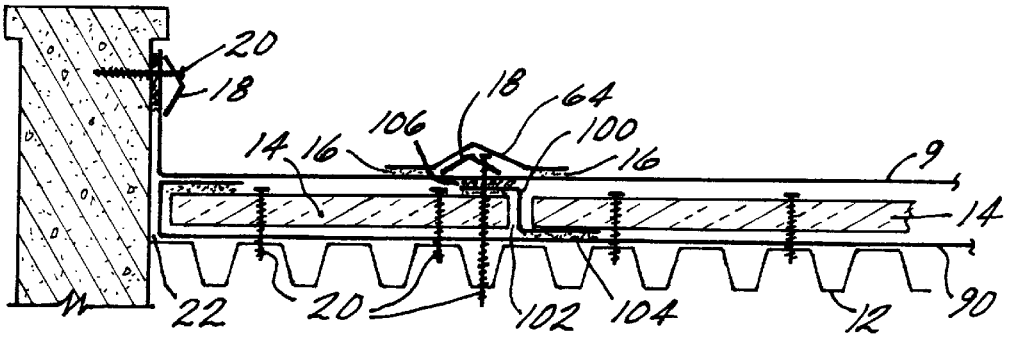
FIG. 29 is an embodiment of the invention wherein the secondary seal is adhesively and mechanically attached.

FIG. 29 illustrates another embodiment of the invention wherein a corrugated metal deck is the substrate 12. An air seal membrane 90 is applied over the deck 12 and is wrapped over the insulation 14 at edges 13 of substrate 12. Air seal 90, then, serves as the air seal for the entire deck. In keeping with the maintenance of a bonding site 10–48 inches inwardly from the perimeter 22, insulation 14 is broken within the identified preferred range such that an auxiliary membrane 100 which penetrates through space 102 in insulation 14 to reach air seal 90 and membrane 100 is bonded thereto at 104 as shown with any of the adhesive or bonding methods discussed herein. The other end of membrane 100 is placed for contact with membrane 9 as shown. The contact area 106 is bonded to membrane 9 by the disclosed methods. A screw 20 is then run through contact area 100, insulation membrane 90 and deck 12 to secure the entire assembly. As will be appreciated from the figure, a termination bar 18 is used and an overseal 64 (membrane or zip tape) weatherproofs the penetration of the membrane 9. The perimetrical edge of membrane 9 is secured to parapet 26 mechanically by screw 20 and termination bar 18.

Figure 30:
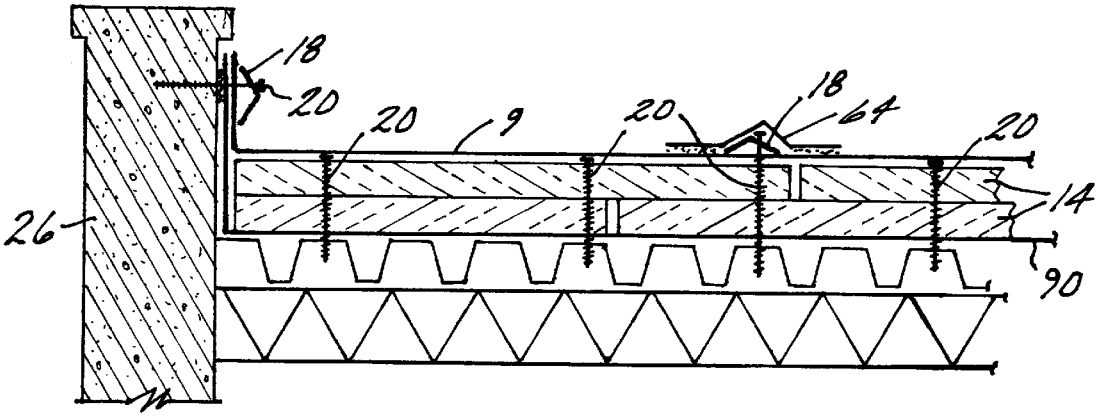
FIG. 30 is a multi layer roof structure wherein the secondary seal is a mechanical attachment.

In FIG. 30 a roof assembly is illustrated which essentially wraps the insulation 14 within air seal 90 and membrane 9.

This embodiment employs two layers of insulation as shown. The two layers of insulation are secured to the roof substrate 12 by a plurality of screws 20 which are driven therethrough and through air seal 90 into substrate 12. Membrane 9 is then secured and weatherproofed as in FIG. 30.

Figure 31:
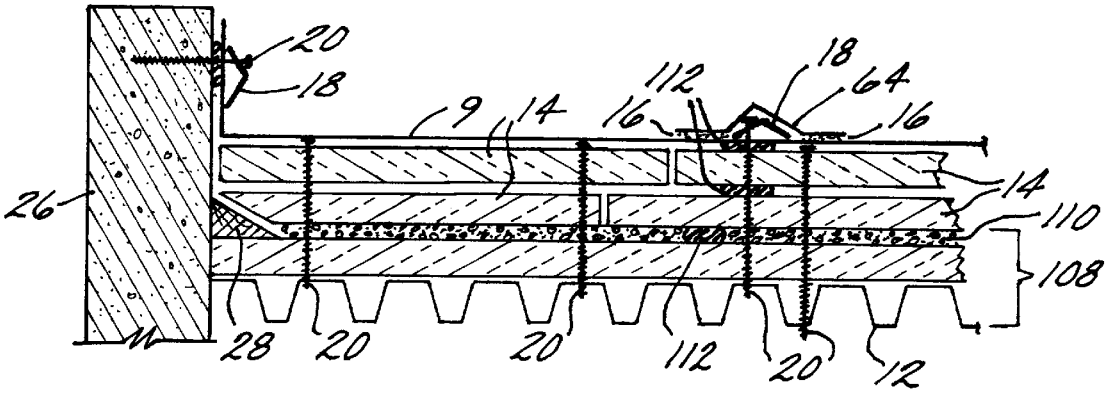
FIG. 31 is a re roofing embodiment where the secondary mechanical seal extends through all layers into the substrate.

FIG. 31 is directed to an embodiment for an existing built up roof (BUR). As one of skill in the art will recognize, the existing BUR includes a deck, insulation and gravel. The BUR is identified by numeral 108. Two layers of insulation 14 are placed over gravel 100 of BUR 108 said insulation being interpositioned with gummy rope 112 (or air seal rope), which prevents air from flowing between insulation layers 14, thus creating a good air seal. Insulation layers 14 are mechanically secured prior to applying the monolithic membrane 9 so as to minimize holes in the final membrane 9. Membrane 9 is secured in the manner in which it was described in FIG. 30 above.

Figure 32:
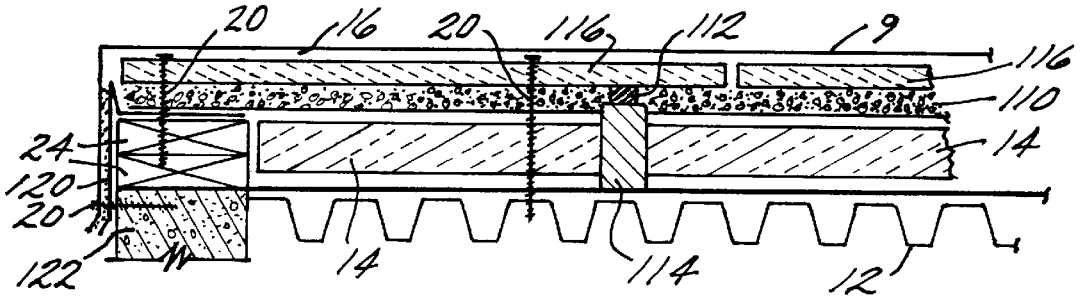
FIG. 32 is an alternate embodiment of the invention.

FIG. 32 illustrates reroofing of a conventional membrane roof having gravel 110 thereover. The insulation is separated at a predetermined distance from perimeter 22 and an air seal 114, constructed of a seal material, wood, metal, etc., is placed between the separated sheets of insulation to provide an air barrier in the desired placement just inwardly from a mechanical fastener to be described hereunder, an air seal rope 112 is then sandwiched between air seal 114 and a membrane protective layer 116 of wood, O.S.B., gypboard, etc. This layer 116 protects the membrane 9 from gravel 110. Fasteners are then driven through the assembly into deck 12 or nailers 24 at top of the wall 122 as shown. Membrane 9 is then adhesively secured to the layer 116 in order to avoid holes in the final membrane 9. Membrane 9 is then also adhesively (16) attached to the existing metal edging 120 and is mechanically attached therethrough and into wall 122.

Figure 33:
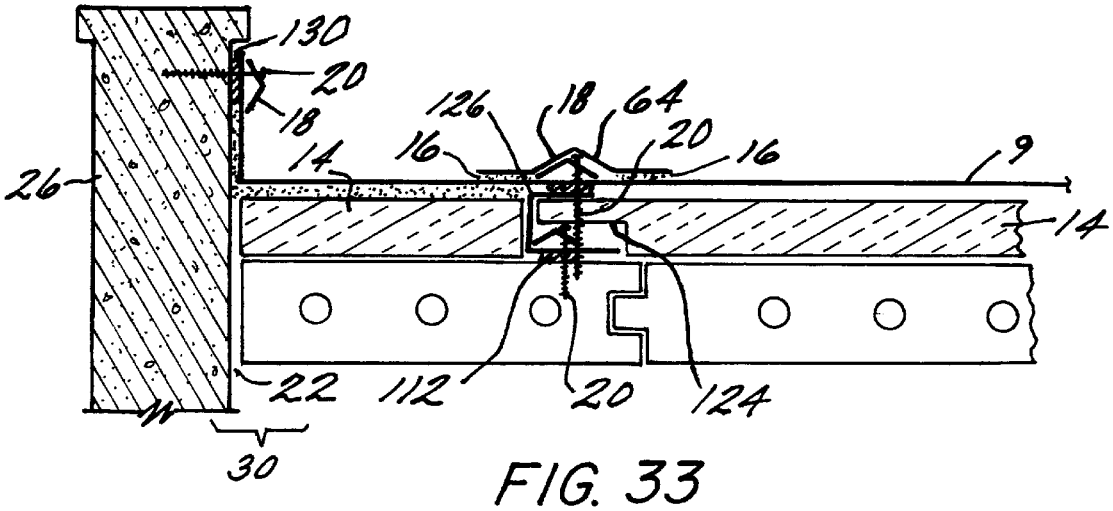
FIG. 33 is another alternate embodiment of the invention using "C" channel as an air seal.

A final embodiment of the invention is illustrated in FIG. 33 wherein a tongue & groove roof substrate 12 is present. Mechanical attachments 18, 20 are located in the parapet 26 and the predetermined distance from interruption 22 and the ensuing zone of instability 30. In the inner attachment area a seal rope 112 is placed upon deck 12 and an air barrier of metal or membrane material is adhered and mechanically attached to the deck by screw 20 and termination bar 18. Insulation 14 is then added on both sides of this attachment with a cutout 124 being provided in insulation 14 to extend over the attachments discussed. The air barrier 126 is then extended through insulation 14 and adhered to monolithic membrane 9 with air seal rope 112. A screw 20 is then driven through all layers as shown, and the assembly is completed as in FIG. 30. It should be appreciated that the membrane 9 is adhesively secured to the insulation 14 and parapet 26 from the mechanical fastener at the desired location, and out to the edge of the membrane.

It will further be appreciated that in any of the above embodiments, termination bar tape may be added under the membrane in the area of the use of a termination bar to further air seal the entire assembly, if desired.

In a related and concurrently practiced concept of this invention a method of sealing the roof assembly around a roof penetration is disclosed. Because a roof penetration or protrusion expands and contracts similarly to a parapet/wall of the building, i.e., longitudinally, there is a zone of instability in the area surrounding a joint between the roof deck and the penetration or protrusion. Therefore it is advantageous to remove the bonding site of the roof membrane to a location a preselected distance from the unstable area. In the case of penetrations and projections, attachment is at a preselected distance from the penetration on the roof and a preselected distance from the intersection on the penetration.

Figure 34:
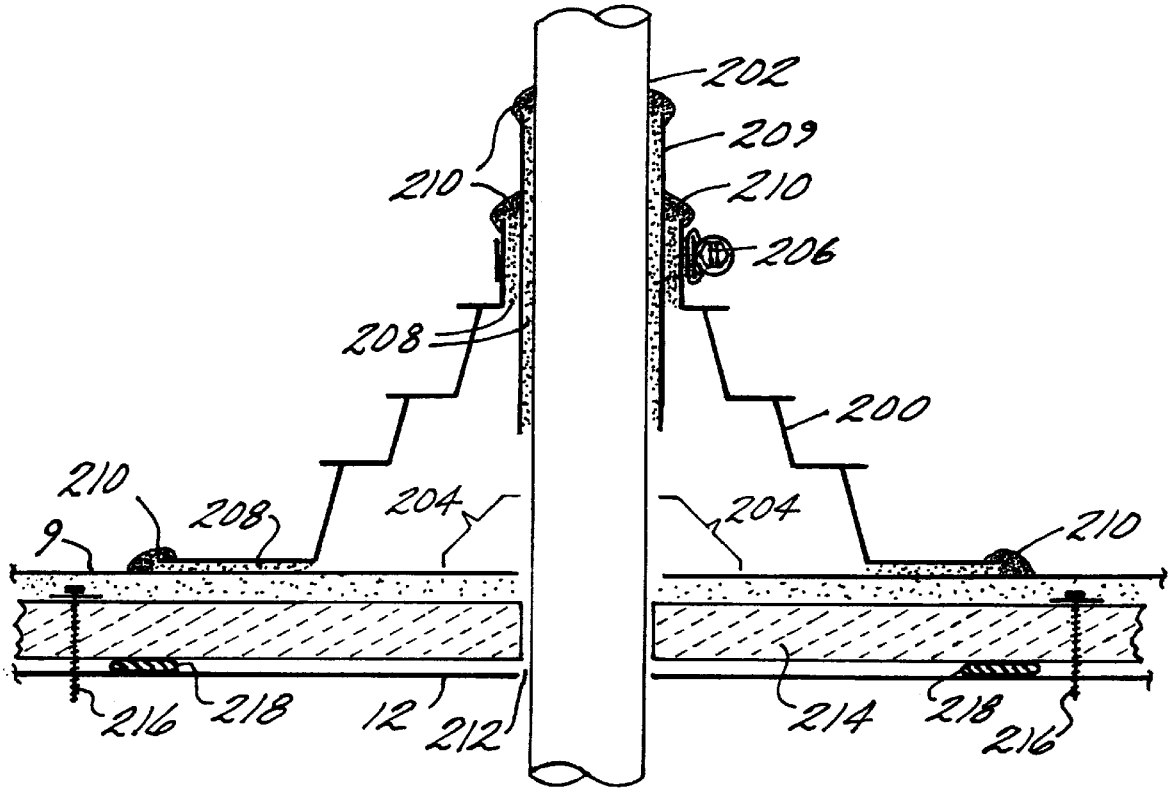
FIG. 34 is a schematic cross sectional view of an air seal around a roof penetration or protrusion which seal is isolated from the zone of instability.

In the embodiment of FIG. 34, a prefabricated pipe boot 200 is positional around a pipe penetration 202. This, therefore, isolates the zone of instability 204 to allow for movement caused by thermal cycling. The boot 200 is preferably secured to pipe 202 by a clamping ring 206 and splicing cement 208 between the pipe and a layer of EPDM flashing 209 and between the flashing 209 and the boot 200 as shown. Cement 208 is also caulked at exposed edges with EPDM paste sealant caulking 210. It will also be appreciated that pipe boot 200 is sealed to the membrane 9 at a preselected distance of from about 6 to about 48 inches from the interruption 212 with cement 208 and caulk 210. The boot 200 and sealing structures and compounds is built most preferably upon a two foot by two foot square O.S.B. 214 which is fastened to substrate 12 by preferably mechanical fasteners 216 which urge the board 214 toward substrate 12 thereby deforming air seal rope 218 to prevent air flow under the roof membrane. The O.S.B. 214 preferably is fastened by eight fasteners 216 having two inch exterior dimension steel plates therearound.

Figure 35:
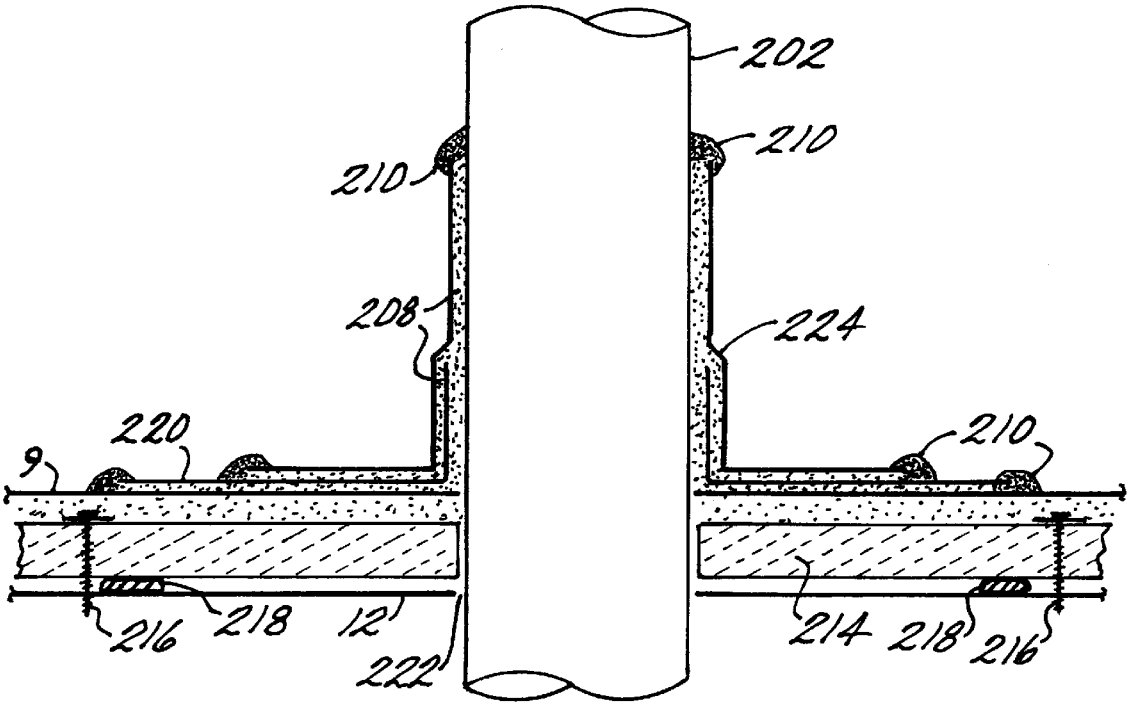
FIG. 35 is another penetration embodiment of the invention.

In another embodiment of the invention the substrate is identical to FIG. 34, however, FIG. 35 dispenses with the preformed pipe boot for larger diameter pipes, vents, etc. In this embodiment, overlapping flashing is adhered to the roof membrane 9 and to the pipe 202 as shown. Flashing 220 extends from a point at least six inches from a point of intersection 222 between the roof membrane 9 and the penetration 202 to the intersection 222 and continues at least two inches up the penetration 202. Flashing second layer 224 extends at least six inches up pipe 202 and at least 2 inches out from pipe 202 along first flashing 220. Cement 208 is placed between pipe 202 and each layer of flashing. Flashing is preferably EPDM. As in FIG. 34 exposed edges of flashing 220, 224 and cement 208 are caulked with paste sealant EPDM caulking 210.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A roof assembly comprising:

a building;

a roof support provided by said building;

an air sealed roof substrate supported by said roof support;

a first waterproof membrane having a primary termination to perimeter edge of said building and a secondary air sealed termination to said substrate about 10 to 48 inches inboard on said roof substrate from a zone of instability;

a second waterproof membrane loose laid over said substrate and air sealed to said first waterproof membrane proximate said secondary air sealed termination.

2. A roof assembly as claimed in claim 1 wherein at least said secondary air seal termination includes a mechanical fastener.

3. A roof assembly as claimed in claim 1 wherein said roof assembly further includes, disposed between said substrate and at least one of said of first and second waterproof membranes, a material selected from the group consisting of OSB wafer board, plywood, water resistant gypsum and insulation.

4. A roof assembly as claimed in claim 1 wherein at least said secondary air sealed termination is sealed with a sealing material selected from the group consisting of caulk, air seal rope, mastic and polymeric sealing materials.

5. A roof assembly comprising:

a building;

a roof support provided by said building;

an air sealed roof substrate supported by said roof support;

a first waterproof membrane loose laid on said substrate and air sealed by an air seal at a perimetrical edge thereof to said substrate, said air seal being located 10 to 48 inches inboard on said substrate from a zone of instability or adjacent a perimeter edge of said building;

a second waterproof membrane loose laid on said substrate and air sealed to said first waterproof membrane at said perimetrical edge of said first membrane, said second waterproof membrane being further air sealed to said perimeter edge of said building.

6. A roof assembly as claimed in claim 5 wherein at least one of said air seals includes a mechanical fastener.

7. A roof assembly as claimed in claim 5 wherein said roof assembly further includes, disposed between said substrate and at least one of said of first and second waterproof membranes, a material selected from the group consisting OSB wafer board, plywood, water resistant gypsum and insulation.

8. A roof assembly as claimed in claim 5 wherein at least one of said air seals is sealed with a sealing material selected from the group consisting of caulk, air seal rope, mastic and polymeric sealing materials.

9. A roof assembly comprising:

a building;

a roof support provided by said building;

an air sealed roof substrate supported by said roof support;

a waterproof membrane loose laid and extending over said building;

a primary termination terminating said membrane to said substrate at least one of a perimetrical edge of said membrane, penetrations of said membrane and protrusions of said membrane;

a secondary termination which is an air seal, sealing said membrane to said substrate at about 10 to 48 inches inboard from a zone of instability which is inboard of said primary termination.

10. A roof assembly as claimed in claim 9 wherein said secondary termination is constructed with a sealing material and a mechanical fastener.

11. A roof assembly as claimed in claim 9 wherein said secondary termination directly fastens said membrane to said substrate.

12. A roof assembly as claimed in claim 9 wherein said secondary termination indirectly fastens said membrane to said substrate by attaching a separate section of waterproof material to said membrane and also to said substrate.

13. A roof assembly comprising:

a building;

a roof support provided by said building;

an air sealed roof substrate supported by said roof support;

a waterproof membrane upwardly adjacent said substrate and spaced therefrom to define with said substrate a laterally air permeable volume;

an air seal extending from said membrane to said substrate at about 10 to about 48 inches from a zone of instability on said roof.

* * * * *